US006022618A

United States Patent [19]

Arai

[11] Patent Number: 6,022,618

[45] Date of Patent: Feb. 8, 2000

[54] PAPER CORD FOR RECYCLING USED PAPER

[75] Inventor: Shinji Arai, Iwate, Japan

[73] Assignee: Kitakamiseishi Kabushiki Kaisha, Japan

[21] Appl. No.: 09/170,119

[22] Filed: Oct. 13, 1998

[30] Foreign Application Priority Data

Jun. 22, 1998 [JP] Japan ..... 10-189607

[51] Int. Cl.[7] ..... D02G 3/00; D21F 7/00

[52] U.S. Cl. ..... 428/357; 162/196

[58] Field of Search ..... 428/357, 364; 162/196

[56] References Cited

U.S. PATENT DOCUMENTS 2,871,652 2/1959 Schwartz ..... 162/196
3,168,802 2/1965 Linke et al. ..... 162/196

OTHER PUBLICATIONS

Mizuhiki Cord 1998.
Ehime's Traditional Specialty Products "Mizuhiki" Date (1603–1867).

*Primary Examiner*—Newton Edwards
*Attorney, Agent, or Firm*—Rogers & Killeen

[57] ABSTRACT

Disclosed is a paper cord which is used for binding old newspaper or old magazines for recycling and which can be charged into a material dissolving apparatus together with the old newspaper or the old magazines.

The paper cord is prepared by twisting a base paper which is a recycled paper characterized by a content of recycled pulp from old newspaper of 33% or more and a total content of recycled pulp including recycled pulp from other sources of 50% or more as well as by whiteness and strength equivalent to or better than those of newsprint paper and degree of sizing equivalent to that of newsprint paper for offset printing.

6 Claims, 2 Drawing Sheets

PAPER CORD FOR RECYCLING USED PAPER

BACKGROUND OF THE INVENTION

1. Field of the Invention

The present invention relates to a paper cord for recycling used paper, which cord is useful for binding a stack of old newspaper deposited for recycling.

2. Description of the Related Art

Old newspaper is useful as a used paper for recycling, because the volume per unit kind is large, because the progress in deinking technology makes the recycling easier, and because the recycled paper can be used for paper other than newsprint paper.

Usually, old newspaper is accumulated for a period of about one month by individual readers and is then put to collecting route together with inserts. In this case, the old newspaper is placed in a paper bag previously supplied from a newspaper distributing shop or piled up to make a stack of folded newspaper which is bound with a plastic cord made of polyvinyl chloride, polyethylene, or the like.

Although part of the old newspaper, which has been collected in these small units, is transported, as it is, to paper manufacturing companies, most of the newspaper units are recombined into bales each having a weight of about 900 kg in order to facilitate transportation or handling. When making a bale, the old newspaper is taken out of the paper bag, or unbound, and the inserts are removed depending on the uses of the recycled paper. The old newspaper thus separated is compressed by a hydraulic press and bound with a wire to form a bale, which is transported to a paper manufacturing company to be put to a recycling process.

The above-described recycling procedure, however, is associated with the following problems:

(1) The plastic cord, which is used for binding the old newspaper, cannot be used as a material for pulp, and therefore it must be disintegrated.

(2) The paper bags supplied from a newspaper distributing shop include kraft paper bags and fine paper bags. Although the fine paper bags may be treated in the same way as the inserts, most of the kraft paper bags are intentionally eliminated because the kraft paper often causes brown dirts in the recycled material depending on deinking methods.

Accordingly, if the plastic cords, which bind the small units of the old newspaper accumulated by individual readers, are changed to a paper cord, which can be recycled and therefore can be charged, as it is, into a material dissolving apparatus (which is usually called a pulper), the expected advantages are rise in the recycling efficiency, cost reduction, and elimination of the industrial waste.

SUMMARY OF THE INVENTION

It is therefore the object of the present invention to provide a paper cord to be used in the recycling of used paper for binding old newspaper or old magazines, which cord can be charged into a material dissolving apparatus as a material for recycled paper together with the old newspaper or the old magazines.

The paper cord for use in the recycling of used paper of the present invention which is made to solve the above-described problems is a paper cord for recycling used paper, which cord is prepared by twisting a base paper composed of a recycled paper characterized by a content of recycled pulp from old newspaper of 33% or more and a total content of recycled pulp including recycled pulp from other sources of 50% or more as well as by whiteness and strength equivalent to or better than those of newsprint paper and degree of sizing equivalent to that of newsprint paper for offset printing.

That is, paper cords for use in binding used paper in general, mostly old newspaper and magazines, in recycling white materials should be limited to white cords. However, since the white cords have a limited number of kinds and since the properties (such as strength, moisture resistance, solubility, and dispersibility) of the white cords are not necessarily suited for the recycling process of used paper such as old newspaper and old magazines, the paper cord of the present invention is composed as described above.

Further it is very convenient to use the paper cord of the present invention, if the paper cord is provided with blue or red marks at a prescribed interval therebetween by using a dilute solution of a color adjusting dye which is used when producing a newsprint paper. That is, when old newspaper, which is folded in fourths and accumulated for a period of one month, is bound crosswise with a paper cord, the length required of the cord is about 2.5 m. If the paper cord is provided in advance with marks for every specific length therebetween, it is not necessary to measure the required length with a measuring rod or the like for cutting the paper cord into the required length at every time when the old newspaper is bound and therefore the wastage can be desirably saved. However, in order not to allow the marking ink to cause undesirable dirts when the paper cord is recycled to be used as a material for recycled paper, the marks need to be produced by using a color adjusting dye (such as methyl violet, crystal violet, rhodamine, and the like) for newsprint paper, and the marks need to have a minimum density that can be recognized.

DETAILED DESCRIPTION OF THE PREFERRED EMBODIMENT

Figure 1:
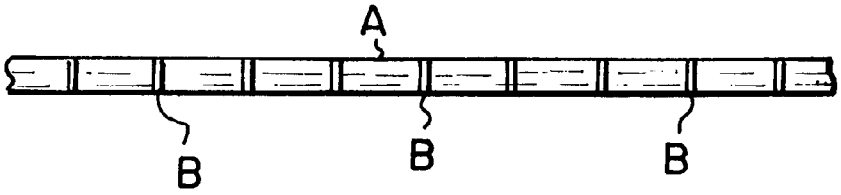
FIG. 1 is a front view of a paper cord of the present invention for use in the recycling of used paper.
Figure 3:
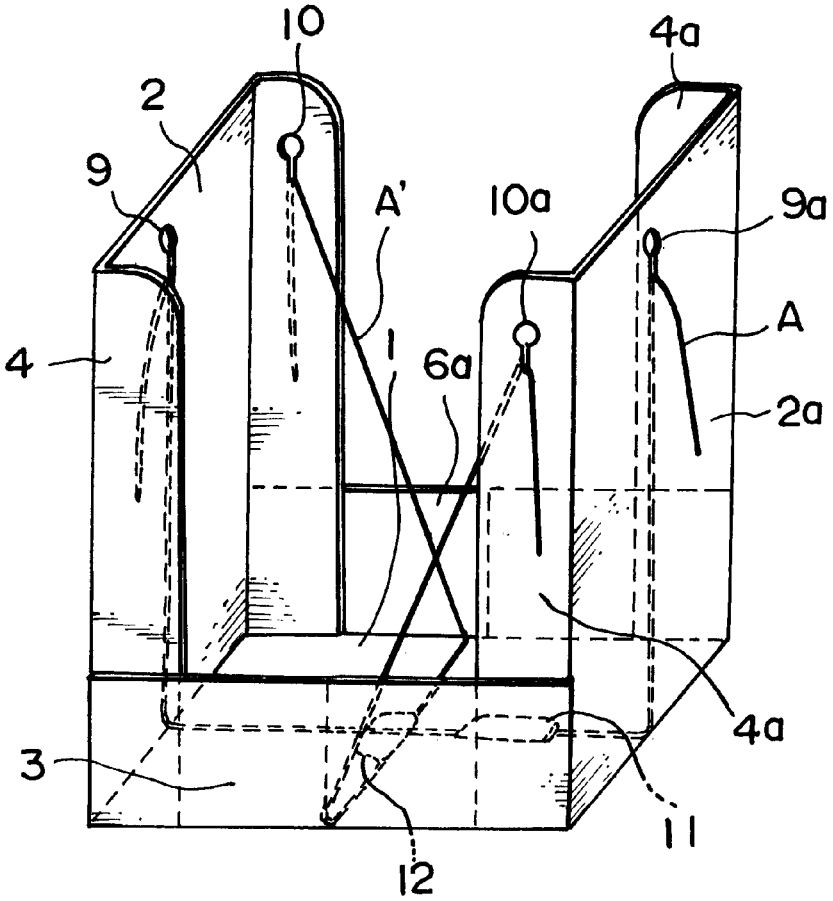
FIG. 3 is an oblique view illustrating the stocking box of FIG. 2 after being assembled and set with a paper cord of the present invention.
Figure 2:
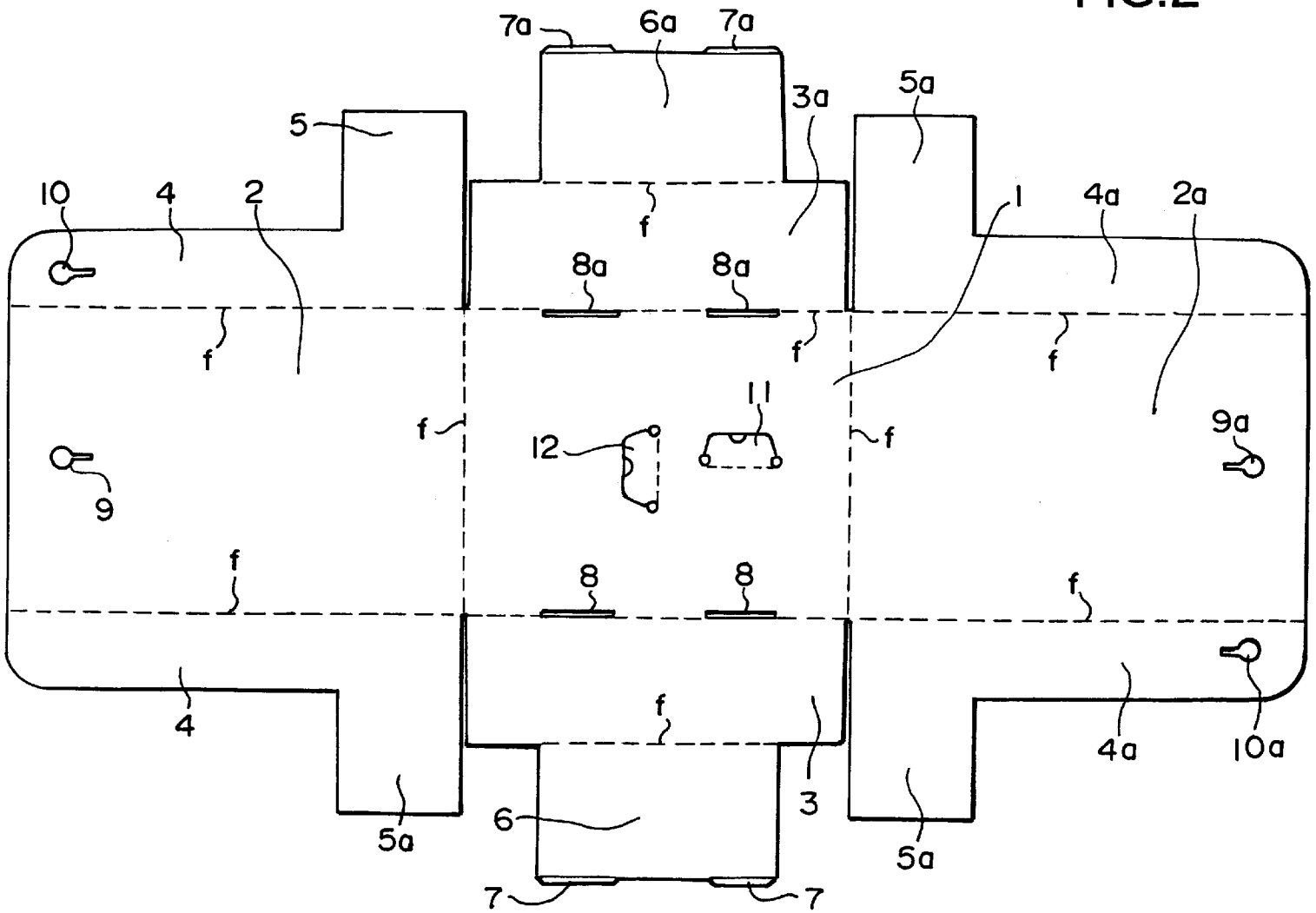
FIG. 2 is a spread top view illustrating a box for stocking old newspaper.

The present invention is further explained below by way of examples. FIG. 1 is a front view of a paper cord of the present invention. FIG. 2 is a spread top view illustrating an old newspaper stocking box which uses a paper cord of the present invention. FIG. 3 is an oblique view illustrating the box of FIG. 2 after being assembled and set with a paper cord of the present invention.

EXAMPLES (1) The following raw materials:

| | |
|---|---|
| deinked recycled pulp from old newspaper (DIP) | 40% |
| recycled pulp from bleached used kraft paper (recycled KP) | 30% |
| bleached kraft pulp from soft woods | 30% |

were formulated, (2) and were fed to a paper machine normally used for manufacturing newsprint paper. Thus, a base paper, having a basis weight of 38 g/m$^2$, for paper cord was produced by surface-sizing in the same sizing condition as newsprint paper by means of a size press.

(3) The base paper was converted into a ribbon roll paper having a width of 76 mm by means of a bobbin winder.

(4) The ribbon roll paper was twisted into a paper cord A having a diameter of 2.5 mm by means of a cord making machine.

(5) Before the winder of the cord making machine, a timer-actuated air-piston type felt marker was positioned. The marker was used to provide blue marks (graduations) B at an interval of 10 cm by using a 0.01% methyl violet solution as a marking ink.

The tensile strength of the base paper for the paper cord manufactured in this way was 3.6 Kgf. The paper cord A, which was manufactured by twisting the base paper, had a strength sufficient for binding old newspaper in an amount of 7.5 Kg and handling the bound unit.

As set forth previously, FIG. 2 is a spread top view illustrating an old newspaper stocking box to which the paper cord A of the present invention is set. FIG. 3 illustrates the state of the box after being assembled and set with the paper cord A of the present invention. The old newspaper stocking box is made by cutting a paper which is robust and can be recycled. The structure of the box is as follows. A bottom wall 1 has an area larger than the folded old newspaper. Left and right walls 2 and 2*a* are provided symmetrically to the left and right sides, respectively, of the bottom wall 1. Front and back walls 3 and 3*a* are provided symmetrically to the front and back sides, respectively, of the bottom wall 1. Pillar walls 4 and 4*a* are provided to the front and back of the left and right walls 2 and 2*a,* respectively. The pillar walls 4 and 4*a* have insert walls 5 and 5*a* provided, respectively, to the sides thereof adjacent to the bottom wall 1 so that the insert walls 5 and 5*a* are set inside the front and back walls 3 and 3*a,* respectively, when assembled. The outer sides of the front and back walls 3 and 3*a* are provided, respectively, with folding walls 6 and 6*a* designed for enclosing the insert walls 5 and 5*a* with the front and back walls 3 and 3*a,* respectively, to thereby fix the insert walls 5 and 5*a* to the bottom wall 1. Holes 9 and 9*a* for a paper cord are provided respectively in the upper part of the left and right walls 2 and 2*a,* while holes 10 and 10*a* for a paper cord are provided respectively in the upper part of the diagonally disposed pillar walls 4 and 4*a,* so that the paper cords are passed slackly through the opposing holes. In the approximate center of the bottom wall 1, hinged tongues 11 and 12 are provided. As shown in FIG. 2, the paper cords A and A', which are passed through the holes 9 and 9*a* as well as through holes 10 and 10*a* in a slackened state, are held by the tongues 11 and 12, respectively.

As described above, old newspaper is consecutively accommodated in the old newspaper stocking box having the paper cords A and A' set thereto. After a period of about one month, when the box is completely filled with the old newspaper, if the paper cords A and A' are pulled out from the holes 9 and 9*a* as well as from holes 10 and 10*a,* respectively, and then the old newspaper is bound from left and right sides with the paper cord A, while bound from front and back sides with the paper cord A', and if the bound old newspaper is lifted up, the old newspaper can be easily taken out of the box because the paper cord A and A' are detached from the box. The bound newspaper, as it is, can be fed to recycling. When the stocking box is used again, new paper cords A and A' are set to the box. Besides, when setting the paper cords A and A', it is not necessary to use a measuring rod or the like, because the length can be easily known by the marks B provided at an appropriate interval on the paper cord.

As stated above, the paper cord is prepared by twisting a base paper composed of a recycled paper characterized by a content of recycled pulp from old newspaper of 33% or more and a total content of recycled pulp including recycled pulp from other sources of 50% or more as well as by whiteness and strength equivalent to or better than those of newsprint paper and degree of sizing equivalent to that of newsprint paper for offset printing. Accordingly, the paper cord itself is suited for recycling, and, therefore, the paper cord, which is used for binding old newspaper or old magazines for recycling, can be charged into a material dissolving apparatus together with the old newspaper or the old magazines.

Further, from the handling standpoint of the paper cord of the present invention, it is very convenient if the paper cord is provided with blue or red marks at a prescribed interval therebetween by using a dilute solution of a color adjusting dye which is used when a newsprint paper is produced, because the length of the paper cord can be easily known by the marks.

What is claimed is:

1. A twisted paper cord comprising:

at least 33% recycled newspaper pulp;

at least 50% recycled pulp from sources other than newspaper; and size sufficient to produce a whiteness, strength, and degree at least equivalent to newsprint suitable for offset printing.

2. The twisted paper cord of claim 1 including marks at prescribed intervals along the length of the cord.

3. The twisted paper cord of claim 2 wherein said marks include a dilute solution of a color adjusting dye of the type used when newsprint is produced.

4. The twisted paper cord of claim 3 wherein said marks are red.

5. The twisted paper cord of claim 3 wherein said marks are blue.

6. The twisted paper cord of claim 1 wherein said marks are provided at regular intervals.

* * * * *